United States Patent [19]

Shapiro

[11] 4,418,819

[45] Dec. 6, 1983

[54] DUAL CONTAINER APPARATUS

[76] Inventor: Richard N. Shapiro, 512 N. Oakland St., Arlington, Va. 22203

[21] Appl. No.: 431,056

[22] Filed: Sep. 30, 1982

[51] Int. Cl.[3] ..... B65D 77/00

[52] U.S. Cl. ..... 206/216; 206/508; 206/509; 206/516; 222/142.3; 222/143; 222/151; 220/23; 220/339

[58] Field of Search ..... 206/216, 253, 256, 504, 206/508, 509, 516, 5.1; 222/142.1, 142.2, 142.3, 143, 151, 543; 220/23, 255, 337, 339

[56] References Cited

U.S. PATENT DOCUMENTS

| | | | |
|---|---|---|---|
| 1,176,871 | 3/1916 | Stoner | 206/216 |
| 1,758,303 | 5/1930 | Wild | 220/337 |
| 1,870,907 | 8/1932 | Groomes et al. | 206/256 |
| 3,485,416 | 12/1969 | Fohrman | 222/142.1 |
| 3,645,284 | 2/1972 | Krezanoski et al. | 220/254 |
| 3,695,280 | 10/1972 | Sturgeon | 206/5.1 |
| 3,768,633 | 10/1973 | Nathan | 206/5.1 |
| 4,036,357 | 7/1977 | Czelen | 206/5.1 |
| 4,308,952 | 1/1982 | Paulucci | 206/216 |

FOREIGN PATENT DOCUMENTS

| | | | |
|---|---|---|---|
| 1206658 | 2/1960 | France | 206/216 |

*Primary Examiner*—Joseph Man-Fu Moy
*Assistant Examiner*—David Fidei
*Attorney, Agent, or Firm*—Ross F. Hunt, Jr.

[57] ABSTRACT

A dual container apparatus is provided which enables two different materials to be contained in the same integral unit separately from one another and to be dispensed separately from their associated container, while that container is still connected to, or is separated from, the other container. Each container includes a detachable cover and these covers are hinged to a common cover member. The covers are also detachably connected together by the common cover member so that the containers can be stacked. A projection and socket arrangement is used to connect each of the covers to the common cover member. In one embodiment, the sockets are formed by a plurality of apertures in the covers which also serve to dispense the materials contained therein (e.g. salt and pepper) and the common cover member includes corresponding projections.

10 Claims, 3 Drawing Figures

DUAL CONTAINER APPARATUS

FIELD OF THE INVENTION

The present invention relates to containers and receptacles for various materials which provide for separate housing of at least two different materials.

BACKGROUND OF THE INVENTION

In many instances, containers are provided which contain materials or substances which are either mixed together or used in conjunction with each other. Examples range from the very simple, e.g., salt and pepper shakers, and rouge and powder compacts to the more complex, e.g., the separate housing of different chemical reactants which are ordinarily separated because they are dangerous when mixed but which are mixed together by the user under suitable conditions to produce a desired result.

Patents of interest in this general field and/or of interest insofar as the present invention is concerned include U.S. Pat. No. 917,804 (Sedgwick); U.S. Pat. No. 941,303 (Borden); U.S. Pat. No. 1,758,303 (Wild); U.S. Pat. No. 1,841,933 (Bowers); U.S. Pat. No. 2,256,892 (Esposito, Jr.); U.S. Pat. No. 3,485,416 (Fohrman); U.S. Pat. No. 3,800,974 (Mogel et al); U.S. Pat. No. 4,036,357 (Czelen); U.S. Pat. No. 4,158,902 (Chernak et al); and U.S. Pat. No. 4,261,486 (Bush et al) and Australian Pat. No. 20,703/34 (Reilly). Other patents of possible interest include U.S. Pat. No. 281,556 (Richardson); U.S. Pat.No. 819,336 (Carnes); U.S. Pat. No. 821,579 (Austen); U.S. Pat. No. 853,497 (Carnes); U.S. Pat. No. 1,269,207 (Nolan).

SUMMARY OF THE INVENTION

In accordance with the invention, a dual container apparatus is provided which is of the general type described above and which permits at least two different materials to be stored separately in a compact convenient stacked unit while enabling the contents of the individual containers to be dispensed separately, either while the containers are connected together or completely separated from one another.

According to a preferred embodiment thereof, the invention comprises a container apparatus for separately housing at least two materials, the apparatus comprising a first container having an opening in one end thereof; a second container having an opening in one end thereof; a first cover for the opening of the first container; a second cover means which is adapted to be selectively and detachably connected to each of the first and second covers so as to form an integral unit with the covers when connected thereto; means for hingedly connecting the first and second covers to the further cover means, the covers and the further cover means including projection and socket means for detachably connecting the further cover means to the covers such that when the covers are so connected to the cover means, the containers are supported in stacked relationship to one another.

In one embodiment thereof, which can be used, for example, in dispensing salt and peper, the projection and socket means comprises projections of different sizes formed on opposite sides of the further cover means and apertures of corresponding sizes formed in the respective ones of the covers to which the further cover means is connected, these apertures additionally serving to dispense the contents of their associated containers.

More generally, the further cover means preferably comprises a cover member having at least one projection formed on each side thereof and constituting the projections of the projection and socket means and the covers each include at least one socket therein in which a corresponding projection is received and which constitute the sockets of the projection and socket means. In an advantageous embodiment, the sockets comprise apertures or holes in the covers and these holes are conveniently used for dispensing purposes.

In another embodiment, the further cover means comprises first and second cover members detachably connected together. Preferably, these cover members define a chamber therebetween which can act as a further container, Advantageously, the containers include detachable attachment means, preferably comprising a nipple formed on the side of one of the container and a recess formed in the side of the other, for enabling the containers to be connected together in side by side relationship when one of the covers is disconnected from the further cover means. In general, each of the containers would include such a nipple and recess.

In accordance with a further advantageous feature of the invention, the cover member includes thumb tab means for facilitating disconnection of the cover member from the individual covers.

Other features and advantages of the invention will be set forth in, or apparent from, the detailed description of a preferred embodiment which follows.

DESCRIPTION OF THE PREFERRED EMBODIMENTS

Figure 1:
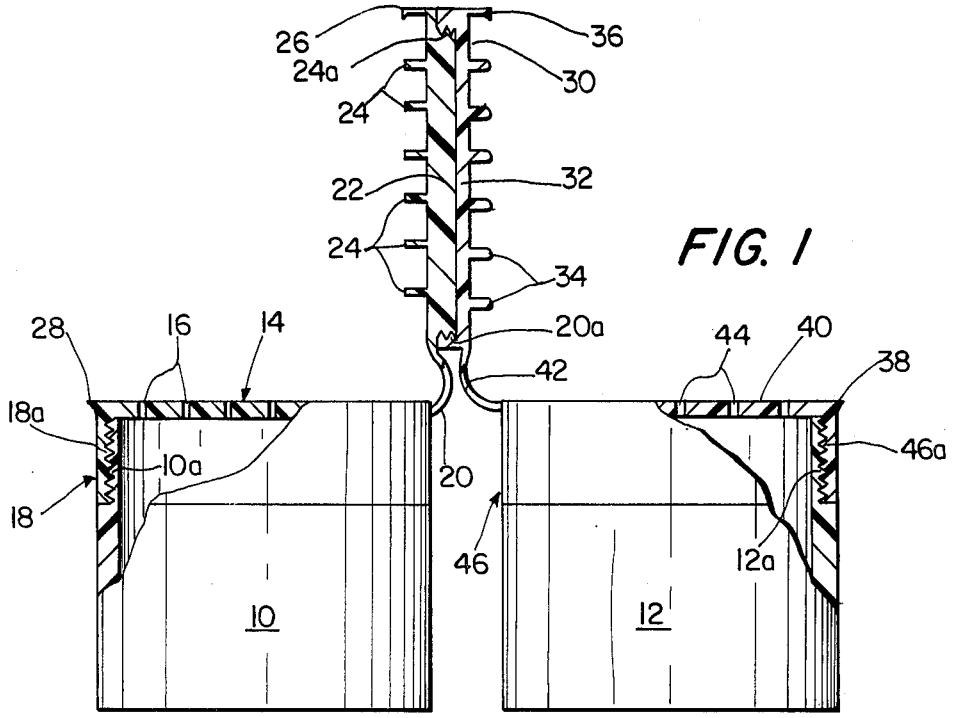
FIG. 1 is a side elevational view, partially in section, of a first embodiment of the container apparatus of the invention.

Referring to FIG. 1, a first embodiment of the invention is shown. Although this embodiment is described relative to the use thereof in dispensing salt and pepper, it will be appreciated that this embodiment, with suitable modification, can be used in retaining and/or dispersing other materials whether liquid or solid. As shown, the apparatus includes a pair of receptacles or containers 10 and 12 which are preferably cylindrical in construction but could be of other shapes.

Receptacle 10 includes a removable intermediate cover or closure 14 having a plurality of apertures 16 therein. Apertures 16 permit dispensing of material from receptacle 10, the material in this case being pepper. Intermediate cover 14 includes a downwardly depending skirt portion 18 which is threaded at **18*a* to enable the intermediate cover to be screwed onto receptacle 10, threads 18*a* cooperating with corresponding threads 10*a* of receptacle 10**.

Intermediate cover 14 is hinged by a flexible hinge 20 to a top or upper cover or closure 22. Hinge 20, and covers 14 and 22, are preferably constructed of a plastic which permits easy movement of top cover 22 between the position shown to a position wherein top cover 22 is seated on intermediate cover 14. A plurality of projections or nipples 24 is provided on the underside of cover 22 in a pattern matching that of apertures so that projections 24 can be inserted in apertures 16 and thereby secure upper cover 22 in place on container 10. Thus apertures 16 serve both as dispensing holes for the product in container 10 and as a means for providing engagement between covers 14 and 22. A inwardly curved thumb tab portion 26 cooperates with a projection 28 on cover 14 to provide additional engagement between covers 14 and 22, and a means for readily disengaging top cover 22 from intermediate cover 14.

Cover 24 includes screw threading indicated at 24*a* which permits cover 24 to be secured to a further upper cover 30, the latter being provided with cooperating screw threading indicated at 20*a*. It will, of course, be understood that covers 22 and 30 can be connected together in other ways, e.g., by a snap fit, as can cover 14 and container 10.

Although perhaps of limited significance for the particular application under consideration, a chamber 32 may be formed between upper covers 22 and 30 for holding additional materials or substances which can, for example, be used with the materials held by containers 10 and 12.

Cover 30 of container 12 is, as shown, quite similar in construction to cover 22 of container 10 and the containers themselves are also quite similar. In this regard, cover 30 includes projections or nipples 34 as well as a tab 36 which engages a projection 38 when cover 30 is in the closed position thereon. Projection 38 is formed on a further intermediate cover 40 which is hinged to upper cover 30 by flexible hinge 42 and includes a plurality of apertures 44 formed therein. Apertures 44 receive projections 34 and thus serve the same functions as apertures 16 of container 10. In the specific embodiment under consideration, salt in container 12 is dispersed through apertures 44. Intermediate cover 40 includes a skirt 46 which is screwed, by means of threads 46*a*, onto threads 12*a* of container 10.

In use, with top covers 22 and 30 in engagement with intermediate covers 14 and 40, containers 10 and 12 are vertically stacked and form a cylindrical unit which can be oriented in any manner with impunity because the nipples 24 and 34 seal apertures 16 and 44 and prevent egress of the contents of containers 10 and 12. It will be appreciated that this resultant unit is very convenient to handle and store while serving to house two different materials without mixing thereof. Further, either container can be readily "opened" by simply disengaging the appropriate tab, either 25 or 36, and lifting and swinging away the uppermost cover and, further, the two containers can be easily separated by disconnecting top covers 22 and 30. Of course, the contents of containers 10 and 12 can be readily replenished by screwing off the respective intermediate covers 14 and 44.

Figure 2:
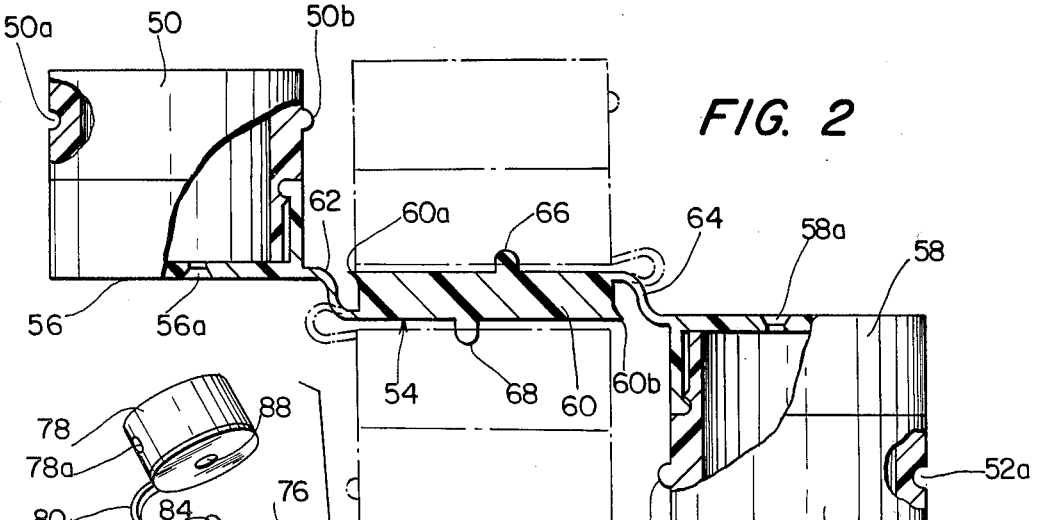
FIG. 2 is a side elevational view, partially in section, of a second embodiment of the container apparatus of the invention.

A second embodiment of the invention is shown in FIG. 2. In this embodiment two containers 50 and 52 are provided. Containers 50 and 52 are preferably cylindrical and include an opening at one end. Container 50 includes a recess 50*a* and nipple 50*b* while container 52 includes a similar recess 52*a* and nipple 52*b*.

A cover assembly generally denoted 54 includes first and second cover portions 56 and 58 and an intermediate or common portion 50. Intermediate portion 60 is hinged at one side by a first flexible hinge 62 to first cover portion 56 and is hinged at the other side by a second flexible hinge 64 to second cover portion 68.

Cover portions 56 and 58 are constructed to snap onto respective containers 50 and 52. Corresponding tabs 60*a* and 60*b* are provided on opposing sides of intermediate portion 60 for assisting in "opening" of containers 50 and 52.

Intermediate portion 60 includes first and second projections or nipples 66 and 68 which are adapted to be received in apertures 56*b* and 58*b* in cover portions 56 and 58, respectively, and which thus enable cover portion 60 to be snapped onto cover portions 56 and 58 and hence form the stacked and sealed assembly shown in dashed lines in FIG. 2. It will be understood that apertures 56*b* and 58*b* can also serve as dispensing apertures although the cover portions 56 and 58 can simply be removed from containers 50 and 52 to gain access to and/or dispense the contents thereof. It will be appreciated that the "assembled" position shown in dashed lines in the embodiment of FIG. 2 also provides an extremely neat unitary package for disparate materials. Further, the nipples and recesses provided on the sides of the containers 50 and 52 enable one container to be joined to the other when one is being used. For example, with container 50 in the position shown in dashed lines and container 52 in the position shown in solid lines, the latter can be connected to the former by nipple 52*b* and recess 50*a*. This enables the contents of container 52 to be dispensed through aperture 58*b* while still retaining a unitary construction.

Additionally, in each of the embodiments, a single hinge element may be employed thereby eliminating the second hinge. For example, referring to FIG. 2, flexible hinge 62 may be eliminated. In such an embodiment, container 52 would merely be completely separable, or resiliently connected to container 50 by the cooperation of projection 52*b* and recess 50*a*. However, it will be understood that the unitary intermediate portion 60 of FIG. 2 may alternatively be composed of two separable portions as evidenced by the closure member described in FIG. 1.

Figure 3:
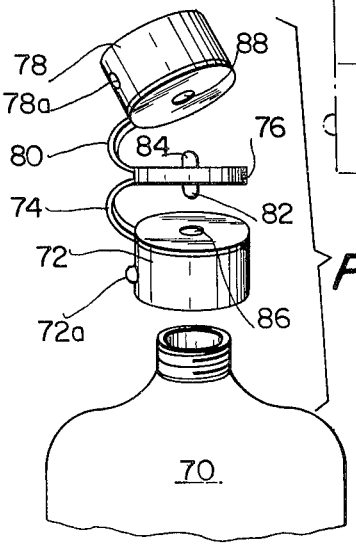
FIG. 3 is an exploded perspective view of a further embodiment of the container apparatus of the invention.

Referring to FIG. 3, a further embodiment of the invention is shown. In this embodiment, a container 70 includes a screw top 72. Screw top 72 is hinged by a flexible hinge 74 to an intermediate cover member 76. A second container 78 is also hinged, by a further flexible hinge 80, to cover member 76. Cover member 76 includes projections 82 and 84 on opposite sides thereof which are received in corresponding apertures 86 and 88 of screw top 72 and second container 78. A nipple 72*a* on screw top 72 is adapted to be received in a recess in 78*a* of second container 78.

This embodiment is particularly useful where a large amount of a first material and a small amount of second material are to be dispensed. The arrangement illustrated enables the integrity of one container to be maintained while the contents of the other are being dispensed. Further, small container 78 can be snapped onto cap 72 by means of recess 78*a* and nipple 72*a* when the contents of container 70 are being dispensed.

Although in each of the illustrated embodiments, the nipples are formed on the "top" cover (for example, the intermediate cover portion in FIG. 2), it will be understood that a recess can be formed in this cover and a projection or nipple (with or without a dispensing aperture) formed on the intermediate covers.

Although the invention has been described relative to exemplary embodiments thereof, it will be understood by those skilled in the art that variations and modifications can be effected in these exemplary embodiments without departing from the scope and spirit of the invention.

I claim:

1. A container apparatus for separately housing at least two materials, said apparatus comprising:

a first container having an opening in one end thereof;

a second container having an opening in one end thereof;

a first cover for said opening of said first container;

a second cover for said opening of said second container;

a further cover means which is adapted to be selectively and detachably connected to each of said first and second covers so as to form an integral unit with said covers when connected thereto; and means for hingedly connecting said first and second covers to said further cover means;

said covers and said further cover means including projection and socket means for detachably connecting said further cover means to said covers such that when said covers are so connected to said cover means said containers are supported in stacked relationship to one another.

2. A container apparatus as claimed in claim 1 wherein said projection and socket means comprises projections of different sizes formed on opposite sides of said further cover means and apertures of corresponding sizes formed in the respective ones of said covers to which said further cover means is connected, said apertures additionally serving to dispense the contents of their associated containers.

3. A container apparatus as claimed in claim 1 wherein said further cover means comprises a cover member having at least one projection formed on each side thereof and constituting the projections of the projection and socket means and wherein said first and second covers each include at least one socket therein in which a corresponding projection is received and which constitute the sockets of the projection and socket means.

4. A container apparatus as claimed in claim 3 wherein said sockets comprises apertures in said covers.

5. A container apparatus as claimed in claim 1 wherein said further cover means comprises first and second cover members detachably connected together.

6. A container apparatus as claimed in claim 5 where cover members define a chamber therebetween.

7. A container apparatus as claimed in claim 1 wherein said containers include detachable attachment means for enabling said container to be connected together in side by side relationship when one of said covers is disconnected from said further cover means.

8. A container apparatus as claimed in claim 7 wherein said detachable attachment means comprises a nipple formed on the side of one of said containers and recess formed in the side of the other.

9. A container apparatus as claimed in claim 8 wherein each of said containers includes a said nipple and a said recess.

10. A container apparatus as claimed in claim 5 wherein said cover member includes thumb tab means for facilitating disconnection of said cover member from said covers.

* * * * *